US009828757B2

(12) United States Patent
Boren

(10) Patent No.: US 9,828,757 B2
(45) Date of Patent: Nov. 28, 2017

(54) DISTRIBUTED CONTROL SYSTEM FOR A VACUUM SEWER SYSTEM

(75) Inventor: William Bret Boren, Southlake, TX (US)

(73) Assignee: IP Sensing, Inc., Brachfield, TX (US)

( * ) Notice: Subject to any disclaimer, the term of this patent is extended or adjusted under 35 U.S.C. 154(b) by 298 days.

(21) Appl. No.: 13/013,796

(22) Filed: Jan. 25, 2011

(65) Prior Publication Data

US 2011/0180161 A1 Jul. 28, 2011

Related U.S. Application Data

(60) Provisional application No. 61/298,666, filed on Jan. 27, 2010, provisional application No. 61/315,341, filed on Mar. 18, 2010.

(51) Int. Cl.
*E03B 1/00* (2006.01)
*E03F 1/00* (2006.01)

(52) U.S. Cl.
CPC ..... *E03F 1/006* (2013.01); *Y10T 137/7761* (2015.04); *Y10T 137/8593* (2015.04)

(58) Field of Classification Search
CPC ..... E03B 1/006; Y10T 137/8593; Y10T 137/7761

(Continued)

(56) References Cited

U.S. PATENT DOCUMENTS 4,179,371 A 12/1979 Foreman et al.
4,691,731 A 9/1987 Grooms et al.

(Continued)

FOREIGN PATENT DOCUMENTS

JP 2003-217059 7/2003
WO 2008/057076 5/2008
WO 2011/094237 8/2011

OTHER PUBLICATIONS

Transaction history of U.S. Appl. No. 61/298,666 (retrieved Jul. 17, 2015).

(Continued)

*Primary Examiner* — Eric Keasel

(57) ABSTRACT

A distributed control system for a vacuum sewer system comprising a suction pipe which is communicated with a vacuum source via a transport conduit (520) by opening a vacuum valve (530) using a solenoid valve is disclosed. The transport conduit is connected between the vacuum valve and a collection tank, with the collection tank having a vacuum source relative to atmospheric pressure applied thereto. The suction pipe is connected between the vacuum valve and a sewage sump, with the sewage sump have a source of sewage maintained at atmospheric pressure. Sewage (551) in the sump is sucked through the suction pipe and sent to the collection tank via the transport conduit by opening the vacuum valve. A transport conduit section is laid out in a sawtooth fashion, having in series transport conduit portions comprising a low-point conduit portion (522), a riser conduit portion (521), and a down-slope conduit portion (523). A valve pit apparatus (500) for control and monitoring the valve pit operations is provided with a battery powered electronic computer, a plurality of sensors, and a solenoid valve. A transport conduit apparatus for monitoring the transport conduit conditions is provided with a riser conduit sensor (550) capable of detecting sewage conditions within the riser and communicating the conditions to a computer (551) for processing.

When the vacuum valve (530) is intermittently opened by control of the valve pit apparatus (500), sewage (551) in the sump is intermittently injected under the influence of atmospheric pressure into the transport conduit (520) for transportation to the collection tank, which passes through the (Continued)

transport conduit riser (521) and detected by the transport conduit apparatus for processing. The results of the valve pit apparatus and the transport conduit apparatus processing are stored in computer memory as operating parameters and then wirelessly communicated to devices external of the valve pit apparatus and transport conduit apparatus. The distributed control system provides an apparatus and method for control and monitoring of the vacuum sewer system, which is complex in sensor placement operating parameters processing but simple in structure, easy to maintain and capable of stable operation.

25 Claims, 6 Drawing Sheets

(58) Field of Classification Search
USPC ..... 137/205, 907, 393, 395, 557; 406/192
See application file for complete search history.

(56) References Cited

U.S. PATENT DOCUMENTS 5,044,836 A * 9/1991 Grooms ..... 406/22
5,064,314 A 11/1991 Grooms et al.
5,261,437 A * 11/1993 Kalix ..... 137/557
5,553,094 A 9/1996 Johnson et al.
5,570,715 A 11/1996 Featheringill et al.
5,588,458 A 12/1996 Ushitora et al.
5,615,978 A 4/1997 Kotani et al.
5,871,027 A * 2/1999 Shimizu et al. ..... 137/205
6,286,602 B1 9/2001 Lemetayer et al.
7,481,100 B2 1/2009 Ponziani et al.
2005/0016588 A1 1/2005 Shimizu et al.
2006/0150749 A1 7/2006 Eken et al.
2008/0314122 A1 12/2008 Hunaidi et al.
2009/0216205 A1 8/2009 Ryan et al.

OTHER PUBLICATIONS

Transaction history of U.S. Appl. No. 61/315,341 (retrieved Jul. 17, 2015).
Transaction history of PCT Application No. PCT/US2011/022477 (retrieved Jul. 17, 2015).
Invitation to Pay Additional Fees and, Where Applicable, Protest Fee from PCT Application No. PCT/US2011/022477 dated Jun. 16, 2011 (2 pages).
Search report and Written Opinion from PCT Application No. PCT/US2011/022477 dated Aug. 30, 2011 (6 pages).

* cited by examiner

DISTRIBUTED CONTROL SYSTEM FOR A VACUUM SEWER SYSTEM

CROSS-REFERENCES TO RELATED APPLICATIONS AND INFORMATION DISCLOSURE

This application claims benefit of U.S. Provisional Application Ser. No. 61/298,666 filed Jan. 27, 2010.

This application claims benefit of U.S. Provisional Application Ser. No. 61/315,341 filed Mar. 18, 2010.

| | | | |
|---|---|---|---|
| 7,481,100 | January 2009 | Ponziani, et al. | Method and apparatus for sensor fault detection and compensation. |
| WO 2008/057076 | May 2008 | Grooms | Vacuum sewage system with wireless alarm. |
| JP2003217059 | July 2003 | Sueyoshi, et al. | SAFETY MONITORING SYSTEM USING VACUOUS SEWERAGE SEWAGE GATHERING DEVICE AND SAFETY MONITORING SYSTEM USING MAINTENANCE SYSTEM OF VACUOUS SEWERAGE SEWAGE GATHERING DEVICE |
| 5,588,458 | December 1996 | Ushitora, et al. | Vacuum valve controller for a vacuum sewer system. |
| 5,553,094 | September 1996 | Johnson, et al. | Radio communication network for remote data generation station. |
| 5,044,836 | September 1991 | Grooms | Electric air admission controller. |
| 4,179,371 | December 1979 | Foreman, et al. | Vacuum Sewage System (sawtooth layout) |

Other References and Disclosure Information: "Not Applicable".

STATEMENT REGARDING FEDERALLY SPONSORED RESEARCH OR DEVELOPMENT

"Not Applicable"

THE NAMES OF THE PARTIES TO A JOINT RESEARCH AGREEMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

Field of the Invention

The present invention relates to a distributed control system for a vacuum sewer system in which sewage in a sump is sucked through a suction pipe by opening a vacuum valve and sent to a predetermined place, e.g., collection tank, and more particularly to apparatuses and methods for monitoring and controlling sewage transportation processes of a vacuum sewer system.

Background Art

FIG. 3 shows one example of the arrangement of a conventional vacuum sewer system which sewage 351 in a sump is sucked through a suction pipe by opening a vacuum valve and sent to a predetermined place. Reference numeral 350 denotes a sewage sump. One end of a suction pipe 310 is inserted into the sump 350. The other, or rear, end of the suction pipe 310 is connected to a sewage transport conduit 320 which communicates with a collection tank (vacuum system and tank not shown) through a vacuum valve 330. A vacuum valve body 331 has in a chamber 332 a diaphragm 333 and a spring 334 for biasing the diaphragm 333 into a valve closing position.

The vacuum valve 330 functions within this system by sealing and unsealing the passage between two parts of an evacuated system to define a vacuum valve cycle. The mechanical vacuum valve controller 390 functions within this system for open/close controlling the vacuum valve 330. The general structure and method of operation of this type of vacuum valve and controller is described in U.S. Pat. No. 5,588,458, issued to Ushitora, et al.

Reference numeral 390 denotes a controller for open/close controlling the vacuum valve 330. The controller 390 has a first input port connected through a pipe assembly 381 to a sump sensor tube 380, which is disposed in the sump 350. In addition, the controller 390 has a second input port connected through a pipe assembly 311 to a suction pipe 310, which is disposed in the sump 350. Further, the controller 390 has an outside air input port connected through a pipe assembly 391 to an outside air breather 392. Furthermore, the controller 390 has a valve output port connected through a pipe assembly 336 to the vacuum valve 330. Finally, the controller 390 has a vacuum source port connected through a pipe assembly 321 to the transport conduit 320.

In the vacuum sewer system arranged as shown in FIG. 3, when the level of sewage in the sump is low, and consequently the system is in a stand-by position, the lower end of the sensor tube lies above the sewage surface. No pressure is detected at the controller's sensor input port which signifies that no sewage is in sump, wherein the controller couples the outside air port to the valve output port. Since atmospheric pressure air through the air breather is communicated to the outside air port and therefore to the valve output port, the chamber 332 in the vacuum valve body 331 is placed under atmospheric pressure. Accordingly, the main valve 335 is pressed in the direction for closing the vacuum valve by the spring 334 and thus set in fully-closed state.

As the level of sewage in the sump rises, the pressure in the sump sensor tube rises. When the pressure in the sump sensor tube exceeds a water column of about 10 inches, the controller couples the vacuum in the transport conduit to the chamber in the vacuum valve body. Thus, the vacuum in the chamber overcomes the force of the spring and raises the main valve from its seat, thereby setting the vacuum valve in the fully-open state (i.e., a state where the bore that provides communication between the suction pipe and the transport conduit is open).

When the vacuum valve is set in the fully-open state, sewage in the sump is sucked up, and the sewage level begins to fall. The pressure in the sump sensor tube immediately drops, wherein the controller couples the atmospheric pressure air from the air breather into the chamber in the vacuum valve body causing the main valve to close.

In the vacuum sewer system arranged as shown in FIG. 4, an operational vacuum sewage system requires that each sewage inlet point, typically serving one or more houses, include a vacuum valve 430 and controller 490, which allows intermittent passage of accumulated sewage 451 into an associated transport conduit 420 network connected at the other end to a collection tank, and thereafter ultimately to a sewage treatment plant. As disclosed in U.S. Pat. No. 4,179,371, issued to B. E. Foreman et al., this transport conduit is typically laid with a saw-toothed profile with a combination of a riser conduit portion 421, low-point conduit portion 422, and down-slope conduit portion 423 (collectively called a "lift") repeated throughout the length of the sewer main to accommodate the topography (e.g., other conduits and rock layers), as well as incoming flows from transport conduits leading to other individual vacuum valves. The slope of the down-slope conduit portions of the profile is such that the drop between lifts is generally equivalent to at least 40% of the conduit diameter (80% if the diameter is smaller than 6") or 0.2% of the distance between lifts, whichever is greater. Generally, the transport conduit network is continuously maintained under vacuum or sub-atmospheric pressure. Sewage and air, usually at atmospheric pressure, are introduced for transport into the conduit through an open vacuum valve. The air moves down the length of the conduit to the area under vacuum or sub-atmospheric pressure where the air expands volumetrically. The energy created by the rapid movement of air in response to the differential pressure condition in the conduit in turn produces rapid sewage transport downstream throughout the conduit system. At a predetermined point in time, however, the vacuum valve will close, thereby ending the sewage transport cycle. The expansion of air causes a reduction in its pressure and velocity, and any residual waste not transported through the conduit network during the sewage transport cycle comes to rest. The conduit downstream of the vacuum valve is equalized by the source of vacuum pressure to a substantially constant sub-atmospheric or vacuum pressure condition throughout. Any residual waste not transported through the conduit during the sewage transport cycle will generally come to rest in the low point portion, permitting vacuum or sub-atmospheric pressure to be communicated upstream and maintained throughout the entire conduit section.

The conventional vacuum sewer system, arranged as described above, however, suffers from the following problems:

Vacuum sewers are a mechanized system of wastewater transport. Unlike gravity flow, vacuum sewers use differential air pressure to move the sewage. Sewer main lines are laid out in a sawtooth profile design so that the wastewater does not completely fill or "seal" the pipe bore. By doing this, air flows above the liquid and the vacuum that is created at the vacuum station can be transferred along the length of the vacuum sewer mains to every valve pit.

The vacuum produced by a vacuum station is generally capable of lifting 13 feet of sewage. Lift is achieved through a sawtooth layout of the lines consisting of two 45-degree fittings connected with a short length of pipe, creating a sawtooth "lift section". Should the lift section be sealed for any reason, liquid is suspended on the downstream side of the lift and an associated vacuum loss is incurred. For every lift section filled with water, about 1 to 2 feet of lift is lost from the modest initial 13 feet of lift, leading to a waterlogged sewer main.

Culvert and utility crossings often dictate numerous variations in the burial depth of sewer mains, resulting in many sags and summits These sags and other poorly constructed sections are the weak points of a system and will be the first lift sections trapped with sewage when the system is stressed, e.g. during periods of high sewage surge flow or extremely low sewage flow. Monitoring the status of these weak points will indicate the overall health of the vacuum sewer system and provide the operator with a preemptive maintenance tool.

It's impossible to know if a lift section underground is waterlogged without the aid of monitoring equipment. However, a simple measurement of pressure drop across the lift section will indicate whether air or liquid is present in the lift section; and while simple in application, it is an otherwise impossible task without installed equipment. The present invention uses the transport conduit apparatus as a monitoring solution that simply measures the conditions of a lift section, and then uses a battery powered computer with wireless capabilities to wirelessly notify the operator of the status, e.g., a waterlogged lift section. There is no existing prior art to monitor the transport conduit conditions as achieved in this present invention.

At the end of the transport conduits are the valve pits which inject sewage in the transport conduits. The mechanical vacuum valve controller in the valve pit is solely a mechanical device with limited capabilities. Cost constraints prohibit the ability to build a solely mechanical vacuum valve controller with abilities to have the multiple sensor input ports and memory of past events, which are required for processing and calculating additional operating parameters, e.g., determining a partially open vacuum valve, calculating the air-to-liquid ratio, and summing sewage usage. The valve pit apparatus described in this invention will incorporate most all the mechanical valve controller features of prior art and incorporate the new features of this invention at an affordable cost for new and existing installations.

Vacuum valves will get stuck open or partially open due to many reasons including sewage solids getting caught in the valve seat. Further, sewer main lines connecting the valve pit to the vacuum station periodically get waterlogged and obstructed. Furthermore, water infiltration and inflow due to leaks and faulty connections will cause inefficient sewer system operations. Incorporating monitoring equipment to detect these theses adverse conditions is desirable. There is no existing prior art that will detect these conditions, in particular, by processing the measurements comprising, vacuum in the valve pit suction pipe and differential pressure across a riser conduit. Additionally, there is no existing art that can easily be retrofitted to existing installed valve pits or transport conduit sections to perform these tasks as mentioned.

A valve may be stuck partially open a small amount or a large amount, wherein knowing the amount the valve is open is important to the operator for determining whether immediate service is required. Prior art valve position sensors just determine if a valve is completely close, but not how much the valve is open. There is no existing prior art that will measure the amount the valve is open, record this condition and save in memory for later retrieval, nor report this condition to the operator for maintenance.

Vacuum sewer transport conduits will get blocked due to waterlogging during times of surge flow, which is indicated by a low vacuum in the transport conduit at the valve pit. Holding the sewage in the sump until the vacuum recovers to a suitable level will help prevent waterlogging the transport conduits during peak times or surge flow conditions, e.g., special community events or rain storms. Prior art designs evacuate the sump at a specific level and do not check for a vacuum level at the transport conduit. This invention will use the sump storage to hold the sewage until the transport conduit vacuum recovers. There is no existing prior art to detect this condition, make decisions based on the conditions, record this condition, save in memory for later retrieval, nor react to and report this condition to the operator for maintenance.

Vacuum sewer transport conduits will become waterlogged when not enough air and too much liquid are present in the conduit. Water hammering is a symptom of a waterlogged transport conduit. There is no existing prior art to detect this condition and attempt to automatically clear this condition by opening and closing a vacuum valve to admit additional air to a vacuum main.

Vacuum sewer systems operate inefficiently when water infiltration and inflow are present due to leaks and improper connections to storm water drains. There is no existing prior art to calculate the amount of sewage usage (amount of evacuated from the sump into the sewer system) per valve pit over a predetermined time period and uses the results for comparison to flow through a transport conduit to determine if there are leaks in the transport conduits. Nor is there existing art to use the sewage usage and flow measurements system-wide to determine the amount of water infiltration and inflow; thereby calculating the efficiency of the vacuum sewer system.

Vacuum sewer transport conduits operate efficiently when there is a proper air-liquid ratio, which is largely determined by the timing of the valve opening and closing time duration. There is no existing prior art to calculate the air flow time and liquid flow time, whereby allowing the calculation of air-to-liquid flow ratio and use this air-to-liquid flow ratio to control the closing of the vacuum valve after opening to evacuate the sump and allowing the proper amount of air to enter the transport conduit. The general explanation and importance of air-to-liquid ratio in a vacuum sewer system is described in U.S. Pat. No. 5,044,836, issued to Grooms. This invention controls the air-to-liquid ratio using real-time control algorithms to determine when enough air has been injected into the transport conduit and then closes the vacuum valve.

Monitoring of vacuum sewer transport conduits has been limited to a simple measurement of the gauge vacuum (reference to atmosphere) at a point in the transport conduit. There is no prior art to measure and calculate the air-to-liquid ratio in the transport conduit, monitor sewage flow through the transport conduit, detect a waterlogged situation in the transport conduit, nor detect water infiltration due to leaks in the transport conduit. The present invention measures sewage conditions in the transport conduit using differential pressure across the riser. This method does not need reference to atmospheric air pressure as in typical vacuum measurement techniques. Furthermore, by monitoring both the injection of sewage into the transport conduits at each valve pit and the flow through the transport conduits at points upstream, a central control computer can detect leaks in the transports conduits. There is no prior art that monitors the conditions in transport conduits, in particularly, measuring conditions by sensing the differential pressure across the riser and not needing reference to atmospheric air pressure as in this patent.

Monitoring of existing installed valve pit equipment comprising vacuum valves, suction pipes, and sensor tubes requires replacing or refurbishing the vacuum valve with a valve position sensor. The present invention can be installed and used without the valve position sensor installed, whereby saving cost. Furthermore, the present invention determines the valve position as open, partially open, or close and the degree of partially open. There is no prior art that allows monitoring the valve position without installation of a valve position sensor on the vacuum valve.

In view of the above-described circumstances, it is an object of the present invention to provide a valve pit apparatus for a vacuum sewer system, which is free from the above-described disadvantages and provides the above-described advantages which is capable of stably operating with a simplified structure. A further object of the invention is a wireless communications means of distributed control for the control and data collection of remote valve pits and transport conduits that is simple and economic to install and maintain. Furthermore, the valve pit apparatus, transport conduit apparatus, and distributed control system presented in this invention is straight forward, simple, affordable, and able to be installed on existing installed valve pits and transport conduits with little labor effort.

BRIEF SUMMARY OF THE INVENTION

A distributed control system for a vacuum sewer system comprising a suction pipe which is communicated with a vacuum source via a transport conduit by opening a vacuum valve using a solenoid valve is disclosed. The transport conduit is connected between the vacuum valve and a collection tank, with the collection tank having a vacuum source relative to atmospheric pressure applied thereto. The suction pipe is connected between the vacuum valve and a sewage sump; with the sewage sump have a source of sewage maintained at atmospheric pressure. Sewage in the sump is sucked through the suction pipe and sent to the collection tank via the transport conduit by opening the vacuum valve. A transport conduit section is laid out in a sawtooth fashion, having series connected transport conduit portions comprising a low-point conduit portion, a riser conduit portion, and a down-slope conduit portion. A valve pit apparatus for control and monitoring the valve pit operations is provided with a battery powered electronic computer, a plurality of sensors, and a solenoid valve. A transport conduit apparatus for monitoring the transport conduit conditions is provided with a riser conduit sensor capable of detecting sewage conditions within the riser and communicating the conditions to a computer for processing.

When the vacuum valve is intermittently opened by control of the valve pit apparatus, sewage in the sump is intermittently injected under the influence of atmospheric pressure into the transport conduit for transportation to the collection tank, which passes through the transport conduit riser and detected by the transport conduit apparatus for processing. The results of the valve pit apparatus and the transport conduit apparatus processing are stored in computer memories as operating parameters and then wirelessly communicated to devices external of the valve pit apparatus and transport conduit apparatus. The distributed control system provides an apparatus and method for control and monitoring of the vacuum sewer system, which is complex in sensor placement and operating parameters processing but simple in structure, easy to maintain and capable of stable operation.

BRIEF DESCRIPTION OF THE SEVERAL VIEWS OF THE DRAWINGS

The accompanying figures, where like reference numerals refer to identical or functionally similar elements throughout the separate views and which together with the detailed description below, are incorporated in and form part of the specification, serve to further illustrate various embodiments and to explain various principles and advantages all in accordance with the present invention.

DETAILED DESCRIPTION OF THE INVENTION

Figure 1:
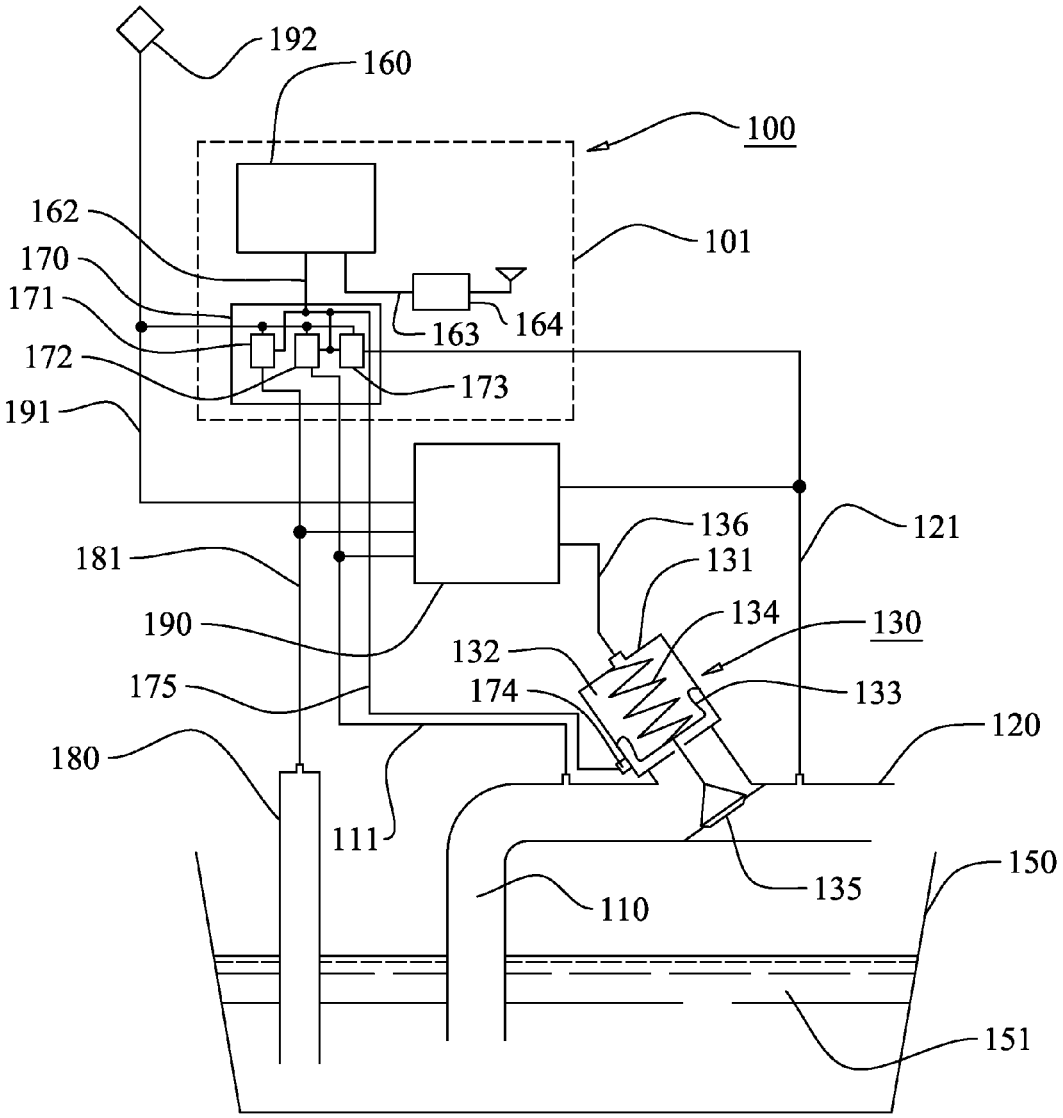
FIG. 1 is a view of one embodiment of an arrangement of a vacuum sewer system having a mechanical vacuum valve controller and the valve pit apparatus of the present invention without a solenoid valve.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms a or an, as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily electrically or mechanically. The terms program, algorithm, firmware, software application, and the like as used herein, are defined as a sequence of instructions designed for execution on a computer, processor, computer system, or programmable controller, or the like. A program, computer program, or software application may include an algorithm, a subroutine, a function, a procedure, an object method, an object implementation, an executable application, an applet, a source code, an object code, a shared library/dynamic load library and/or other sequence of instructions are designed for execution on a computer system, or programmable controller, or the like.

Air-to-Liquid Ratio is the ratio of air to liquid in the sewage transport conduit or ratio of air to liquid injected into a transport conduit at the valve pit. Vacuum sewer systems are designed to operate on two-phase (air & liquid) flows with the air flow being admitted for a time period after the liquid flow. Open time of the vacuum valve is adjustable; hence, various air-to-liquid ratios are attainable.

Calculation is a deliberate process for transforming one or more inputs into one or more results, with variable change.

Close or closed, as used herein, means the valve plunger within the vacuum valve is moved to or in a position so as to bar sewage passage through.

Nearest Fluid Communication means the shorter path of fluid travel, in other words, when comparing points in a fluid travel path, the nearest fluid communication will be the shortest distance from one point to another.

Computer is an electronic machine that manipulates data according to a computer program and sets of instructions (firmware algorithms) to reach a result. The general purpose computer has four main components: the arithmetic logic unit, the control unit, the memory, and the input and output devices. These parts are interconnected by busses, often made of groups of wires.

Drive-by means the ability for an operator walking or driving in a vehicle to collect data from valve pits or other remote equipment using wireless communications with a hand-held unit or laptop equipped with wireless transceiver and dedicated software.

Energizing/Latching (energize/latch) means to apply a momentary voltage to and hold (latch) the mechanical results in place with a magnet or a spring until an opposing momentary voltage is applied which creates an opposing mechanical force greater than the magnet or spring.

Fixed-base means the ability for a computer in a fixed location to collect data from valve pits or other remote areas using wireless communications with fixed-base data collectors spaced throughout the area of valve pits and remote equipment.

Level in regards to pressure level refers to the measurement of pressure in PSI (pounds per square inch). Level in regards to vacuum level refers to the measure of vacuum in inches of Mercury (Hg) or water as referenced to atmospheric air pressure. Level in regards to sewage refers to height in inches.

Operating Parameter is a particular set of variables stored in memory and used in the computer program that holds the value of a sensor measurment or a calculation result from a computer process or a contant variable, whereby operating parameters can be used in firmware algorithm processing by the computer. In accordance to the present invention, only operating parameters are wirelessly communicated to and from other wireless communication devices external of the valve pit apparatus and transport conduit apparatus for data exchange. All other constants and variables are used only for calculations and firmware algorithm processing by the computer.

Partially Open Vacuum Valve means a vacuum valve that is not in the fully open or fully closed position, which is most likely due to an obstruction or a defective valve.

Preset Threshold means a predetermined fixed set point, e.g., pressure level, or constant value or constant value operating parameter in a computer program.

Pressure Sensor means one or more pressure sensing devices which measures pressure relative to atmospheric air pressure or another source of pressure for a differential pressure measurement, comprising pressure transducers and pressure switches. Pressure transducers are considered here as electronic analog devices and pressure switches are condidered here to be electronic digital devices. The use of one pressure transducer will measure a range of levels, whereby only one device is needed. However, analog transducers typically require more power to monitor by the computer due to required periodic polling to detect a pressure level and therefore less time for computer to be in low-power sleep mode. The pressure switch will detect only one specific pressure level at a preset threshold, whereby multiple pressure swiches are needed to detect a range of pressures. However, switches consume less power to monitor by the computer due to capability of interrupting the computer from sleep when a pressure level at the preset threshold is reached so that the computer can remain in low-power sleep mode when not being interrupted.

Solenoid Valve in this invention comprises a 3-way solenoid valve and a solenoid coil driver circuit. A 3-way solenoid valve is an electromechanical valve for use with liquid or gas and has a three-port valve and a solenoid coil driver circuit, whereby an input port coupling is switched between two output ports; however, the coupling is bi-directional so that gas or liquid can flow both in and out both the input and output ports. The valve is controlled by an electric current through a solenoid coil, wherein applying electrical energy with a positive polarity drives the solenoid one direction to couple the input to an output and applying electrical energy with a negative polarity drives the solenoid in the opposite direction to couple the input to the other output.

Sump Full Level means the level of sewage in the sump that the vacuum valve should open and empty if all conditions are good. Typically this level is when the sump is about 20% full and about 10" from the bottom of the sump or about 6" from the bottom end of the sump sensor tube in a standard valve pit.

Sump Overflow Level means the level of sewage in the sump that indicates the vacuum valve should open and empty the sump under any condition. Typically this level is at the same level as the gravity lines feeding sewage into the sump, whereby not cutting off a supply of atmospheric pressure air to the sewage sump via the gravity lines.

Suction Pipe Lower Portion means the lower end of the suction pipe, which is about the last 12 inches from the lower end of the Suction Pipe.

Waterlogged (waterlogging) means the total sewage transport conduit volume is generally greater than two-thirds filled with liquid sewage and less than one-third filled with air. During a sewage transport cycle, the total conduit volume will typically be less than one-third liquid sewage. However, if an insufficient amount of atmospheric air is introduced into the conduit, there will be insufficient energy applied to move effectively the entire sewage mass during the sewage transport cycle. This leads to an increased accumulation of residual sewage material, creating the waterlogged condition that could fill more than two-thirds of the conduit and affect lift volumes.

Water Hammer is a pressure surge or wave resulting when a fluid in motion is forced to stop or change direction suddenly. Water hammer commonly occurs when a valve is closed suddenly at an end of a pipeline system, and a pressure wave propagates in the pipe.

Vacuum (Vacuum Level or Vacuum Pressure) means gaseous pressure less than atmospheric pressure.

Vacuum Recovery Time is the time needed for the vacuum sewer transport conduit at the valve pit connection to recover to a predetermined level of vacuum after the vacuum valve closes at the end of a vacuum valve cycle. The vacuum recovery time is a function of conduit length, conduit diameter, number of valve pit connections to the conduit, ratio of air-to-liquid in the conduits, and resistances in the conduit due to obstructions.

Vacuum Sensor means one or more vacuum sensing devices which measures vacuum relative to atmospheric air pressure or another source of vacuum for a differential vacuum measurement, comprising vacuum transducers and vacuum switches. Vacuum transducers are considered here as electronic analog devices and vacuum switches are condidered here to be electronic digital devices. The use of one vacuum transducer will measure a range of levels, whereby only one device is needed. However, analog transducers typically requires more power to monitor by the computer due to required periodic polling to detect a vacuum level and therefore less time for computer to be in low-power sleep mode. The vacuum switch will detect only one specific vacuum level at a preset threshold, whereby multiple vacuum swiches are needed to detect a range of vacuums. However, switches require less power to monitor by the computer due to capability of interrupting the computer from sleep when a vacuum level at a preset threshold is reached so that the computer can remain in low-power sleep mode when not being interrupted.

Vacuum Valve Cycle is the action of the vacuum valve opening and closing one time, whereby the vacuum valve opens to connect the sump suction pipe to the vacuum system transport conduit and causes any sewage in the sump to be sucked through the suction pipe and sent to a predetermined place by way of the sewer system transport conduits. After a determined amount of time based on the amount of liquid and/or air allowed to pass through the vacuum valve, the vacuum valve completes the cycle by closing which disconnects the suction pipe from the sewer system transport conduit.

The concept of the present invention can be advantageously used on any vacuum sewer system in which sewage in a sump is sucked through a suction pipe by opening a vacuum valve and sent to a predetermined place, e.g., a sewage disposal plant. Although the invention is illustrated herein with reference to a valve pit apparatus for valve pit locations, the invention is alternatively applied to other applications such as, for example, a vacuum valve mounted above the ground, on a wall, or in another apparatus that needs use of a vacuum valve in a vacuum sewer system.

The concept of the present invention can be advantageously used on any vacuum sewer system in which sewage in a sump is sucked through a suction pipe by opening a vacuum valve and sent to a predetermined place, e.g., a sewage disposal plant. Although the invention is illustrated herein with reference to a transport conduit apparatus for a transport conduit section laid out in a sawtooth fashion, the invention is alternatively applied to other applications such as, for example, a transport conduit section that is not laid out in a sawtooth fashion but still having a riser conduit section or a transport riser section and not necessarily using 45 degree angles.

Figure 2:
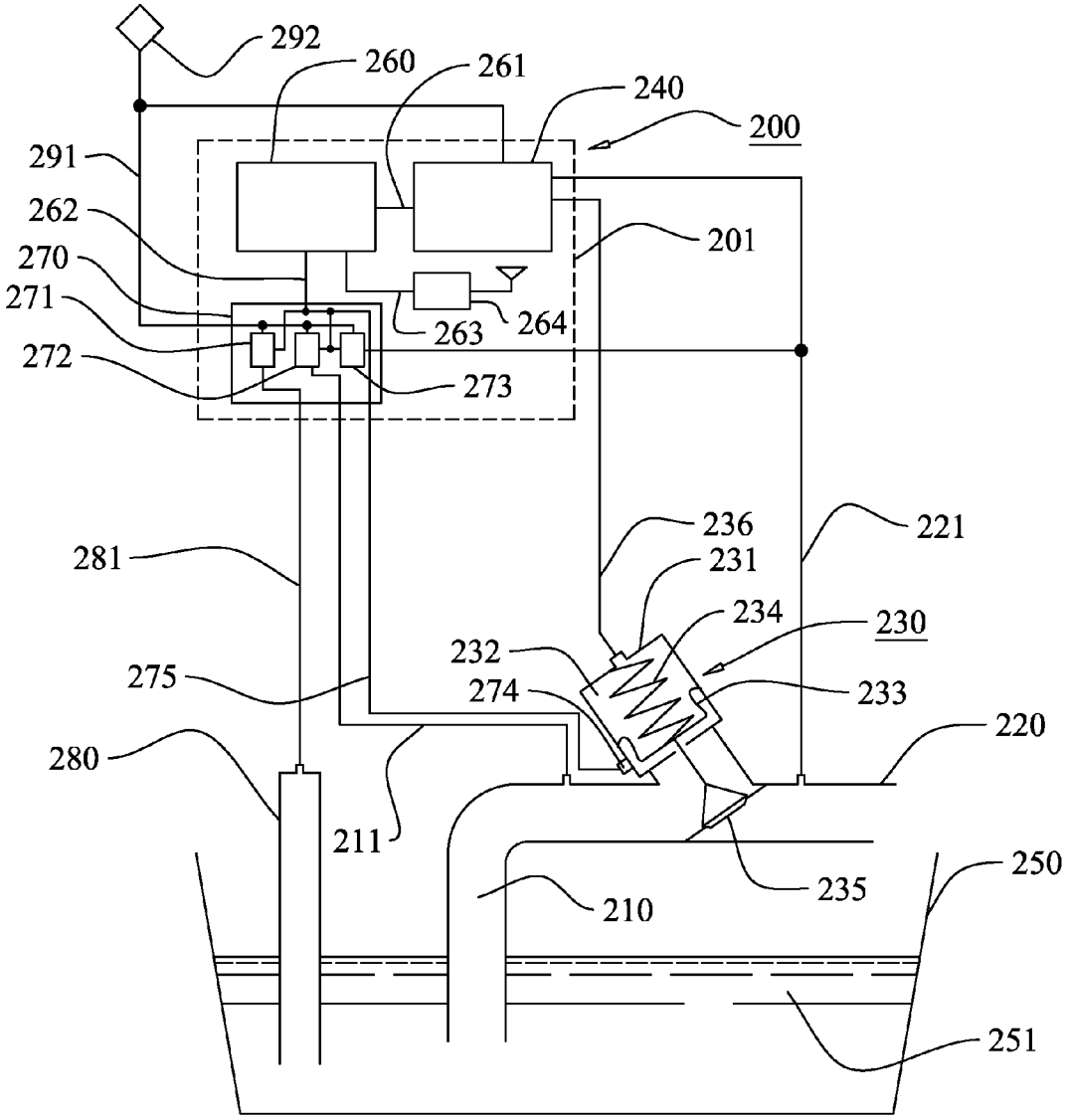
FIG. 2 is a view of a second embodiment of an arrangement of a vacuum sewer system having the valve pit apparatus of the present invention with a solenoid valve.
Figure 3:
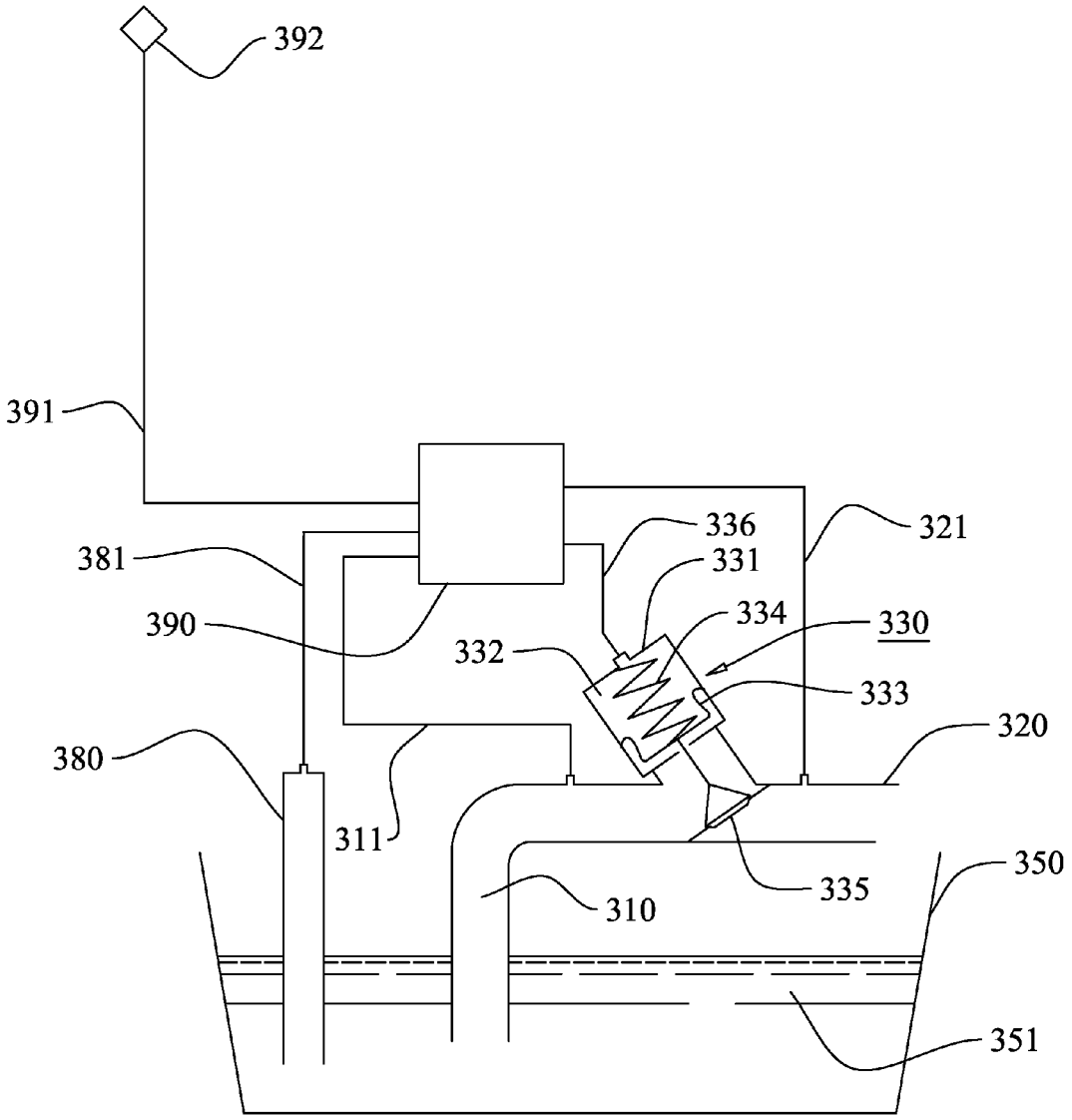
FIG. 3 is a view of a prior art arrangement of a vacuum sewer system having a mechanical vacuum valve controller.
Figure 4:
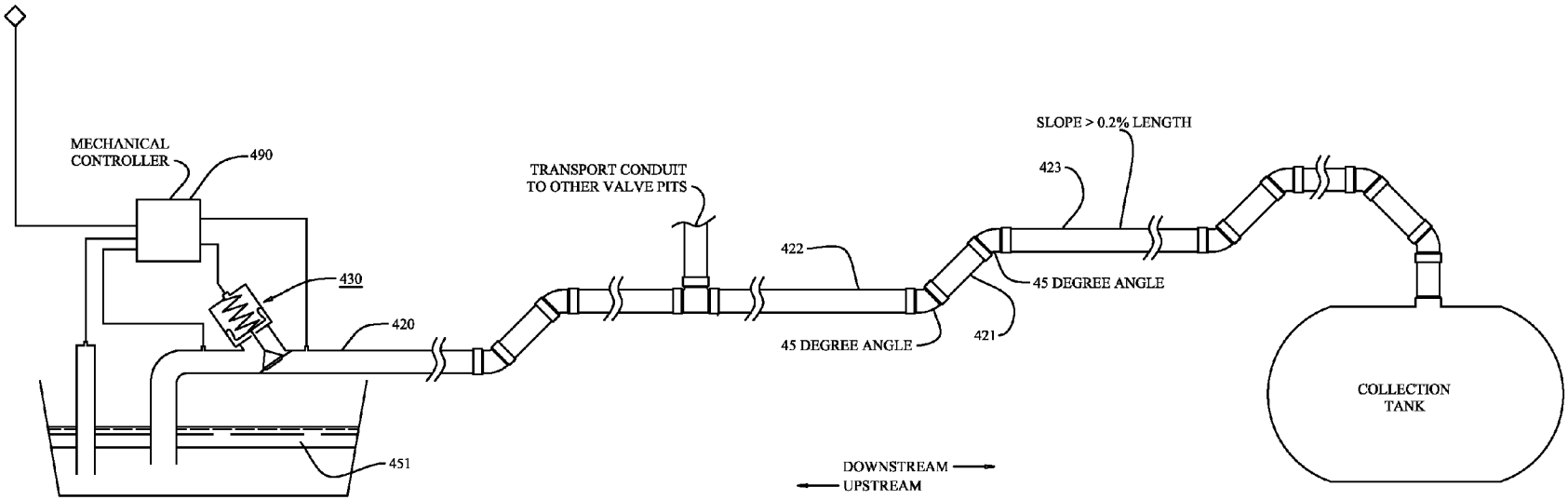
FIG. 4 is a view of a prior art arrangement of a vacuum sewer system having a mechanical vacuum valve controller and a transport conduit section laid out in a sawtooth fashion.
Figure 5:
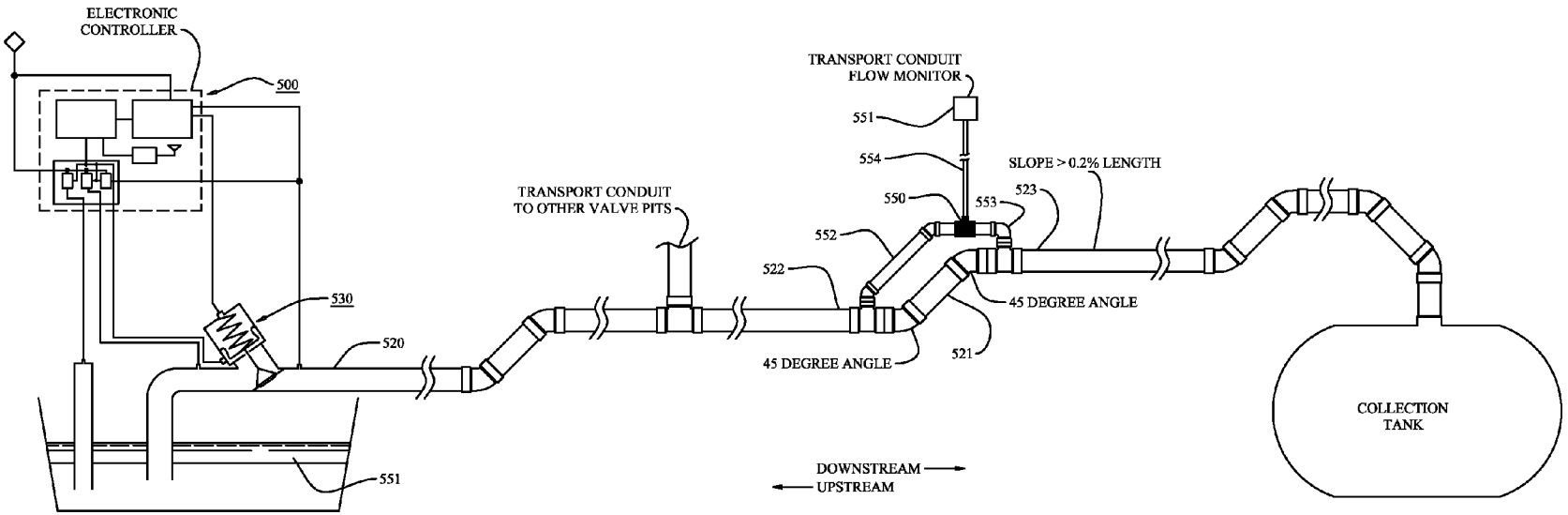
FIG. 5 is a view of one embodiment of an arrangement of a vacuum sewer system having a valve pit apparatus of the present invention and a transport conduit apparatus integrated into a transport conduit section laid out in a sawtooth fashion.
Figure 6:
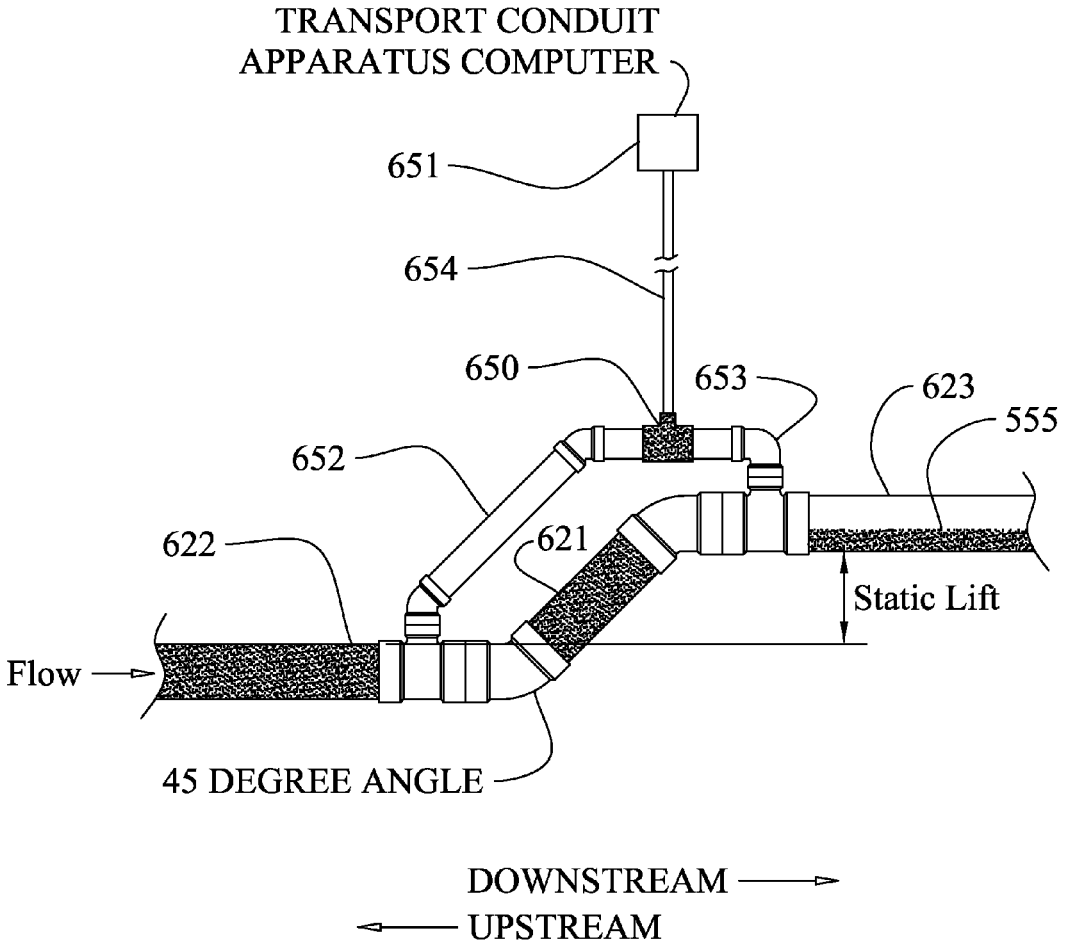
FIG. 6 is a view of one embodiment of a transport conduit apparatus.

Embodiments of the present invention will be described below with reference to the accompanying drawings. FIG. 1 shows an arrangement of a vacuum sewer system having a mechanical vacuum valve controller and the valve pit apparatus of the present invention without a solenoid valve. FIG. 2 shows an arrangement of a vacuum sewer system having the valve pit apparatus of the present invention with a solenoid valve. FIG. 5 shows a view of one embodiment of an arrangement of a vacuum sewer system having a valve pit apparatus of the present invention with a solenoid valve and a transport conduit apparatus integrated into a transport conduit section laid out in a sawtooth fashion. FIG. 6 shows a view of one embodiment of a transport conduit apparatus.

As illustrated in FIG. 1, reference numeral 150 denotes a sewage sump. One end of a suction pipe 110 is inserted into the sump 150. The other, or rear, end of the suction pipe 110 is connected to a sewage transport conduit 120 which communicates with a vacuum tank (vacuum system and tank not shown) through a vacuum valve 130. A vacuum valve body 131 has in a chamber 132 a diaphragm 133 and a spring 134 for biasing the diaphragm 133 into a valve closing position.

The vacuum valve 130 functions within this system by sealing and unsealing the passage between two parts of an evacuated system to define a vacuum valve cycle. The mechanical vacuum valve controller 190 functions within this system for open/close controlling the vacuum valve 130. The general structure and method of operation of this type of vacuum valve and controller is described in U.S. Pat. No. 5,588,458, issued to Ushitora, et al.

Reference numeral 190 denotes a controller for open/close controlling the vacuum valve 130. The controller 190 has a first input port connected through a pipe assembly 181 to a sump sensor tube 180, which is disposed in the sump 150. In addition, the controller 190 has a second input port connected through a pipe assembly 111 to a suction pipe 110, which is disposed in the sump 150. Further, the controller 190 has an outside air input port connected through a pipe assembly 191 to an outside air breather 192. Furthermore, the controller 190 has a valve output port connected through a pipe assembly 136 to the vacuum valve 130. Finally, the controller 190 has a vacuum source port connected through a pipe assembly 121 to the transport conduit 120.

The valve pit apparatus 100, as illustrated in FIG. 1, includes an explosion-proof, water-proof housing 101 for covering, protecting and supporting the internal components encased within, along with providing mechanical structure for interfacing to external devices. Although the invention is illustrated herein with reference to a valve pit apparatus with an explosion-proof, water-proof housing, the invention is alternatively applied to other applications without need of an explosion-proof, water-proof housing, for example, a vacuum valve mounted above the ground in a non-hazardous location, on a wall, or in another apparatus that needs use of a vacuum valve in a vacuum sewer system without need of an explosion-proof nor water-proof housing.

In accordance with the present invention, embodiments of the valve pit apparatus 100 can comprise a computer portion 160, a plurality of sensors portion 170, a solenoid valve portion, and a wireless communications device portion 164 all in a single housing 101. While one could attempt to break the valve pit apparatus into two or more portions with each portion having their own housings and each of the portions communicating with the computer portion through wired connections, whereby attempting to design around or improve the patent, the insubstantial change in dividing the valve pit apparatus into multiple portions would in effect be deemed equivalent to the present invention since it would perform substantially the same function, in substantially the same way, to yield substantially the same result.

In accordance with the present invention, one embodiment of the valve pit apparatus 100 comprises a computer portion 160, a plurality of sensors portion 170, a solenoid valve portion, and a wireless communications device portion 164. Other embodiments in accordance with the present invention could have the valve pit apparatus comprising a computer portion and a plurality of sensors without a solenoid valve portion and/or a wireless communications device portion, which will not be presented here for simplicity. All such modifications and variations are within the scope of the invention as determined by the appended claims.

The illustrated valve pit apparatus 100 in FIG. 1, by way of example only, is one preferred embodiment of a valve pit apparatus, in accordance with the present invention, having an explosion-proof, water-proof housing 101, as is known in the art, and will not be presented here for simplicity.

The illustrated valve pit apparatus 100 in FIG. 1, by way of example only, is one preferred embodiment of a valve pit apparatus, in accordance with the present invention, having an electronic computer circuitry, conventional wireless modem circuitry, signal converter circuitry, and power supply circuitry, as is known in the art, and will not be presented here for simplicity.

As illustrated in FIG. 1, the valve pit apparatus 100 includes a plurality of sensors 170 that communicates through electrical conductors 162 to the computer 160 and through electrical connectors 175 to the vacuum valve position sensor 174, and communicates through pipes to locations comprising the sump sensor tube 180 through pipe assembly 181, the suction pipe 110 through pipe assembly 111, the transport conduit 120 through pipe assembly 121, and the air breather 192 through pipe assembly 191.

In accordance with the present invention, one embodiment of the plurality of sensors 170 comprises a sump sensor tube pressure sensor 171, a suction pipe vacuum sensor 172, a transport conduit vacuum sensor 173, and a vacuum valve position sensor 174. Another embodiment in accordance with the present invention has the plurality of sensors comprising a sump sensor tube pressure sensor, a transport conduit vacuum sensor, and a vacuum valve position sensor without a suction pipe vacuum sensor, which will not be presented here for simplicity. Such modification and variation are within the scope of the invention as determined by the appended claims.

In accordance with the present invention, one embodiment of the plurality of sensors 170 comprises a sump sensor tube pressure sensor 171, a suction pipe vacuum sensor 172, a transport conduit vacuum sensor 173, and a vacuum valve position sensor 174. Another embodiment in accordance with the present invention has the plurality of sensors comprising a transport conduit vacuum sensor and a vacuum valve position sensor without a sump sensor tube pressure sensor and without a suction pipe vacuum sensor, which will not be presented here for simplicity. Such modification and variation are within the scope of the invention as determined by the appended claims.

In accordance with the present invention, one embodiment of the plurality of sensors 170 comprises a sump sensor tube pressure sensor 171, a suction pipe vacuum sensor 172, a transport conduit vacuum sensor 173, and a vacuum valve position sensor 174. Another embodiment in accordance with the present invention has the plurality of sensors comprising a transport conduit vacuum sensor and a suction pipe vacuum sensor without a sump sensor tube pressure sensor and without a vacuum valve position sensor, which will not be presented here for simplicity. Such modification and variation are within the scope of the invention as determined by the appended claims.

As illustrated in FIG. 1, the valve pit apparatus 100 includes a wireless communications device 164 that communicates through electrical conductors 163 to the computer 160.

In the vacuum sewer system arranged as shown in FIG. 1, when the level of sewage 151 in the sump is low, and consequently the system is in a stand-by position, the lower end of the sensor tube lies above the sewage surface. Pressure is not detected at the controller's sensor input port which signifies that no sewage is in sump, wherein the controller 190 couples the outside air input port to the valve output port. Since atmospheric pressure air through the air breather is communicated to the outside air input port and therefore to the valve output port, the chamber 132 in the vacuum valve body 131 is placed under atmospheric pressure. Accordingly, the main valve 135 is pressed in the direction for closing the vacuum valve by the spring 134 and thus set in fully-closed state.

Further, as the level of sewage 151 in the sump 150 rises, the pressure in the sump sensor tube 180 rises. When the pressure in the sump sensor tube exceeds a water column of a predetermined level, e.g., 6 inches, the controller 190 couples the vacuum in the transport conduit 120 to the chamber 132 in the vacuum valve body 131. Thus, the vacuum in the chamber overcomes the force of the spring 134 and raises the main valve 135 from its seat, thereby setting the vacuum valve 130 in the fully-open state (i.e., a state where the bore that provides communication between the suction pipe and the transport conduit is open).

Furthermore, when the vacuum valve is set in the fully-open state, sewage in the sump is sucked up, and the sewage level begins to fall. The pressure in the sump sensor tube 180 immediately drops, wherein the controller 190 couples the atmospheric pressure air from the air breather 192 into the chamber 132 in the vacuum valve body 131 causing the main valve 135 to close.

As illustrated in FIG. 2, reference numeral 250 denotes a sewage sump. One end of a suction pipe 210 is inserted into the sump 250. The other, or rear, end of the suction pipe 210 is connected to a sewage transport conduit 220 which communicates with a vacuum tank (vacuum system and tank not shown) through a vacuum valve 230. A vacuum valve body 231 has in a chamber 232 a diaphragm 233 and a spring 234 for biasing the diaphragm 233 into a valve closing position.

The vacuum valve 230 functions within this system by sealing and unsealing the passage between two parts of an evacuated system to define a vacuum valve cycle. The solenoid valve 240 functions within this system for open/close controlling the vacuum valve 230. In general, the solenoid valve is an electromechanical valve for use with liquid and gas. Further, the valve is controlled by an electric current through a solenoid coil. Furthermore, the solenoid valve has three ports, the outflow is switched between the two outlet ports.

As illustrated in FIG. 2, the valve pit apparatus 200 includes a solenoid valve 240 for open/close controlling the vacuum valve 230 that communicates through electrical conductors 261 to the computer 260. Further, the solenoid valve 240 has a vacuum source port connected through a pipe assembly 221 to the transport conduit 220. Furthermore, the solenoid valve 240 has an outside air input port connected through a pipe assembly 291 to an outside air breather 292. Finally, the solenoid valve 240 has a valve output port connected through a pipe assembly 236 to the vacuum valve 230.

The valve pit apparatus 200, as illustrated in FIG. 2, includes an explosion-proof, water-proof housing 201 for covering, protecting and supporting the internal components encased within, along with providing mechanical structure for interfacing to external devices. Although the invention is illustrated herein with reference to a valve pit apparatus with an explosion-proof, water-proof housing, the invention is alternatively applied to other applications without the need of an explosion-proof, water-proof housing, for example, a vacuum valve mounted above the ground in a non-hazardous location, on a wall, or in another apparatus that needs use of a vacuum valve in a vacuum sewer system without the need of an explosion-proof nor water-proof housing.

In accordance with the present invention, embodiments of the valve pit apparatus 200 can comprise a computer portion 260, a plurality of sensors portion 270, a solenoid valve portion 240, and a wireless communications device portion 264 all in a single housing 201. While one could attempt to break the valve pit apparatus into two or more portions with each portion having their own housings and each of the portions communicating with the computer portion through wired connections, whereby attempting to design around or improve the patent, the insubstantial change in dividing the valve pit apparatus into multiple portions would in effect be deemed equivalent to the present invention since it would perform substantially the same function, in substantially the same way, to yield substantially the same result.

In accordance with the present invention, one embodiment of the valve pit apparatus 200 comprises a computer portion 260, a plurality of sensors portion 270, a solenoid valve portion 240, and a wireless communications device portion 264. Other embodiments in accordance with the present invention could have the valve pit apparatus comprising a computer portion, a plurality of sensors, and a solenoid valve portion without a wireless communications device portion, which will not be presented here for simplicity. All such modifications and variations are within the scope of the invention as determined by the appended claims.

The illustrated valve pit apparatus 200 in FIG. 2, by way of example only, is one preferred embodiment of a valve pit apparatus, in accordance with the present invention, having an explosion-proof, water-proof housing 201, as is known in the art, and will not be presented here for simplicity.

The illustrated valve pit apparatus 200 in FIG. 2, by way of example only, is one preferred embodiment of a valve pit apparatus, in accordance with the present invention, having an electronic computer circuitry, conventional wireless modem circuitry, signal converter circuitry, solenoid driver circuitry, and power supply circuitry, as is known in the art, and will not be presented here for simplicity.

As illustrated in FIG. 2, the valve pit apparatus 200 includes a plurality of sensors 270 that communicates through electrical conductors 262 to the computer 260 and through electrical connectors 275 to the vacuum valve position sensor 274, and communicates through pipes to locations comprising the sump sensor tube 280 through pipe assembly 281, the suction pipe 210 through pipe assembly 211, the transport conduit 220 through pipe assembly 221, and the air breather 292 through pipe assembly 291.

In accordance with the present invention, one embodiment of the plurality of sensors 270 comprises a sump sensor tube pressure sensor 271, a suction pipe vacuum sensor 272, a transport conduit vacuum sensor 273, and a vacuum valve position sensor 274. Another embodiment in accordance with the present invention has the plurality of sensors comprising a transport conduit vacuum sensor, a sump sensor tube pressure sensor, and a vacuum valve position sensor without a suction pipe vacuum sensor which will not be presented here for simplicity. Such modification and variation are within the scope of the invention as determined by the appended claims.

As illustrated in FIG. 2, the valve pit apparatus 200 includes a wireless communications device 264 that communicates through electrical conductors 263 to the computer 260.

In the vacuum sewer system arranged as shown in FIG. 2, when the level of sewage 251 in the sump is low, and consequently the system is in a stand-by position, the lower end of the sensor tube lies above the sewage surface.

Pressure is not detected at the sensor tube pressure sensor 271 which signifies that no sewage is in sump, wherein the solenoid valve 240 couples the outside air input port to the valve output port. Since atmospheric pressure air through the air breather is communicated to the outside air input port and therefore to the valve output port, the chamber 232 in the vacuum valve body 231 is placed under atmospheric pressure. Accordingly, the main valve 235 is pressed in the direction for closing the vacuum valve by the spring 234 and thus set in fully-closed state.

Further, as the level of sewage 251 in the sump 250 rises, the pressure in the sump sensor tube 280 rises. When the pressure in the sump sensor tube exceeds a water column of a predetermined level, e.g., 6 inches, the solenoid valve 240 couples the vacuum in the transport conduit 220 to the chamber 232 in the vacuum valve body 231. Thus, the vacuum in the chamber overcomes the force of the spring 234 and raises the main valve 235 from its seat, thereby setting the vacuum valve 230 in the fully-open state (i.e., a state where the bore that provides communication between the suction pipe and the transport conduit is open).

Furthermore, when the vacuum valve is set in the fully-open state, sewage in the sump is sucked up, and the sewage level begins to fall. The pressure in the sump sensor tube 280 immediately drops, wherein the solenoid valve 240 couples the atmospheric pressure air from the air breather 292 into the chamber 232 in the vacuum valve body 231 causing the main valve 235 to close.

In accordance with the present invention, the valve pit apparatus is characterized by comprising a device with a plurality of sensors connected to the signal input port of an explosion-proof, water-proof, battery powered computer for detecting level and rate-of-change of vacuum in both the suction pipe and transport conduit, detecting level and rate-of-change of pressure in the sump sensor tube, and detecting the vacuum valve position.

The valve pit apparatus is further characterized in that the vacuum within the suction pipe is communicated to the suction pipe vacuum sensor, which measures the vacuum and electrically transmits the vacuum level to the signal input port of the computer, which stores the value as an operating parameter. The suction pipe vacuum sensor communicates to the suction pipe through a low impedance pipe assembly coupled to a vacuum detecting hole in the suction pipe at a location that enables the measurement of the highest level of vacuum present in the suction pipe as a result of suction of sewage up through said suction pipe when said vacuum valve is open or partially open.

The valve pit apparatus is further characterized in that the position of the vacuum valve is sensed by a sensor associated with the vacuum valve, which detects if the vacuum valve is in an open state or close state and electrically transmits the open or closed position to the signal input port of the computer, which stores the value as a vacuum valve state and is used along with the transport conduit vacuum to determine a monitored vacuum valve operating parameter of value equal to open, partially open, close, or unknown.

The valve pit apparatus is further characterized in that the transport conduit vacuum is communicated to the transport conduit vacuum sensor, which measures the vacuum and electrically transmits the vacuum level to the signal input port of the computer, which stores the value as an operating parameter. The transport conduit vacuum sensor communicates to the transport conduit through a low impedance pipe assembly coupled to a vacuum detecting hole in the transport conduit at a location that enables the measurement of the highest level of vacuum present in the transport conduit at the interface between the vacuum valve and transport conduit.

The valve pit apparatus is further characterized in that the sump sensor tube pressure is communicated to the sump sensor tube pressure sensor, which measures the pressure and electrically transmits the pressure level to the signal input port of the computer, which stores the value as an operating parameter. The sump sensor tube pressure sensor communicates to the sump sensor tube through a low impedance pipe assembly coupled to a pressure detecting hole in the sump sensor tube at a location that enables the measurement of the highest level of pressure present in the sump sensor tube, which converts the rising of said sewage within said sewage sump to a pressure for determining a sewage level within the sump.

The valve pit apparatus is further characterized in that it uses the computer and firmware algorithms to monitor and process these measured vacuum level operating parameters, pressure level operating parameters, state variables, and other previously recorded operating parameters stored in memory and then uses the results of the processing to determine additional valve pit operating parameters that define the status of the valve pit components and to operate the vacuum valve, which is controlled by a solenoid valve connected to the computer signal output port.

The valve pit apparatus is further characterized in that the computer has recorded and saved to memory the valve pit operating parameters and thus enabling a wireless communicating device to wirelessly communicate the recorded valve pit operating parameters to and from devices external to the valve pit for both Drive-by and Fixed-Base data exchange operations.

The general structure and method of operation of a Fixed-base wireless data exchange is described in U.S. Pat. No. 5,553,094 issued to Johnson, et al.

The valve pit apparatus is further characterized in that it may alternatively determine the open/close state of the vacuum valve by monitoring the vacuum on each side of the vacuum valve, in other words, the computer will monitor the vacuum in the suction pipe and the vacuum in the transport conduit to determine if the vacuum valve is open or closed. In particular, the computer will determine the vacuum valve to be closed if the transport conduit vacuum is greater than a preset threshold, e.g., 5.0" Hg, and the suction pipe vacuum is less than a preset threshold, e.g., 0.5" Hg. Further, the computer will determine the vacuum valve to be open if the transport conduit vacuum is less than a preset threshold, e.g., 5.0" Hg, and the suction pipe vacuum is greater than a preset threshold, e.g., 0.5" Hg. Furthermore, the computer will determine the vacuum valve to be partially open if the transport conduit vacuum is greater than a preset threshold, e.g., 5.0" Hg, and the suction pipe vacuum is greater than a preset threshold, e.g., 0.5" Hg.

The valve pit apparatus is further characterized in that the apparatus can be used in conjunction with a mechanical vacuum valve controller, whereby the mechanical vacuum valve controller functions within this system for open/close controlling the vacuum valve and consequently the valve pit apparatus continues to operate properly. The valve pit apparatus may determine the open/close state of the vacuum valve by monitoring the vacuum at the transport conduit interface to the vacuum valve opening and the vacuum valve position sensor or valve position sensor, in other words, the computer will monitor the vacuum in the transport conduit to determine if the vacuum valve is open, partially open, or close. In particular, the computer will determine the vacuum valve to be closed if the transport conduit vacuum is greater than a preset threshold, e.g., 5.0" Hg. Further, the computer will determine the vacuum valve to be open if the transport conduit vacuum is less than a preset threshold, e.g., 5.0" Hg. Furthermore, the computer will determine the vacuum valve to be partially open if the valve position sensor detects an open state and the transport conduit vacuum is greater that a preset threshold, e.g. 5.0" Hg.

The valve pit apparatus is further characterized in that the computer determines a condition when a partially open vacuum valve is detected and saves the warning to memory for later retrieval, whereby an operator or fixed-base computer can wirelessly download the valve pit operating parameter and identify the problem that has occurred even though the problem may be cleared at the present moment.

The valve pit apparatus is further characterized in that the computer uses the vacuum in the suction pipe to determine the sewage flow rate through the vacuum valve. The computer determines the flow rate through the vacuum valve by measuring the time for the suction pipe vacuum to increase a fixed amount and then divides a constant valve by this measured time, which the constant value is dependent on the suction pipe inside diameter. In other words, the vacuum in the suction pipe is dependent on the height of sewage in the suction pipe; therefore a rate of change in vacuum is proportional to the rate of change in sewage height in the suction pipe. Knowing the rate of change of sewage height in the pipe gives the velocity of sewage through the pipe and multiplying this velocity times a constant valve proportional to the cross sectional area of the pipe gives an estimated flow rate of sewage through the vacuum valve.

The valve pit apparatus is further characterized in that the computer determines an alarm condition when a partially open vacuum valve is detected and causing an amount of flow to be substantial enough to justify an alarm condition. The alarm condition is determined if the above mentioned vacuum valve flow rate is greater than a preset threshold and the vacuum valve is determined to be partially open. If the computer knows this valve is to be closed by other operating parameters, but the flow rate of sewage in the vacuum valve shows it to be open or partially open, then the computer determines a failure and records the event as an alarm. The computer records this alarm and saves in memory for later retrieval by a device external to the valve pit using the wireless communications capabilities of the apparatus, whereby an operator or fixed-base computer can wirelessly download valve pit operating parameters and identify a problem that has occurred even though the problem is cleared at the present moment.

The valve pit apparatus is further characterized in that the computer defines a vacuum recovery time by measuring the time for the said transport conduit vacuum to increase a fixed amount after the vacuum valve is closed, whereby the transport conduit vacuum is communicated to a vacuum sensor that measures the vacuum and electrically transmits the vacuum level to the computer. The computer determines the vacuum recovery time of the vacuum communicated to the valve pit from the sewer system by measuring the time for the transport conduit vacuum level to increase a fixed amount. In other words, the vacuum in the transport conduit will approach atmospheric pressure while the vacuum valve is open, so when the vacuum valve closes the vacuum in the transport conduit begins to approach the vacuum of the sewer system vacuum source at a rate dependent on the transport conduit resistance, whereby measuring the time it takes for the vacuum in the transport conduit to change a fixed amount will be proportional to the amount of resistance in the transport conduit between the valve pit and the vacuum sewer system vacuum source.

The valve pit apparatus is further characterized in that the computer uses the vacuum in the sewage transport conduit to determine an obstructed sewage transport conduit by detecting the above mentioned vacuum recovery time is greater than a preset threshold. In other words, the vacuum in the transport conduit will approach atmospheric pressure while the vacuum valve is open, so when the vacuum valve closes the vacuum in the transport conduit begins to approach the vacuum of the sewer system vacuum source at a rate dependent on the transport conduit resistance, whereby the more severe the obstruction in the transport conduit between the valve pit and the sewer system vacuum source the longer it will take for the vacuum pressure in the transport conduit to change a fixed amount, thereby an alarm being set if the time is greater than a preset threshold.

The valve pit apparatus is further characterized in that the computer determines a waterlogged sewage transport conduit alarm by measuring a first vacuum recovery time and then measuring a second vacuum recovery time longer than the first vacuum recovery time occurring within 2 seconds of the first vacuum recovery time, whereby detecting a water hammer situation which is indication of a waterlogged transport conduit. In other words, a waterlogged transport conduit is a condition where the air-to-liquid ratio is low in the transport conduit that causes a water hammer effect when the vacuum valve is closed, whereby detection of water hammer will indicate a waterlogged transport conduit. Water hammer in the transport conduit is determined by the detection of an oscillation of vacuum and/or pressure in the transport conduit, which is achieved by detecting a vacuum recovery immediately followed by a vacuum decay and then followed by another vacuum recovery within 2 seconds of the first vacuum recovery.

The valve pit apparatus is further characterized in that the computer determines an air-to-liquid flow time ratio during a vacuum valve cycle by dividing the air flow time by the liquid flow time, whereby the ratio of the two times determines the air-liquid flow time ratio. The liquid flow time is determined by measuring the time the transport conduit vacuum or suction pipe vacuum is greater than a preset threshold after the vacuum valve opens and the air flow time is determined by measuring the time duration after the transport conduit vacuum or suction pipe vacuum has dropped lower than a preset threshold to the point that the vacuum valve closes. In other words, the air-to-liquid ratio is simply the amount of air passed through the valve divided by the amount of liquid sewage passed through the valve during a vacuum valve cycle. The amount of air passed through the valve is estimated by measuring the time the valve remains open after the liquid has finished passing. The amount of liquid passed through the valve is estimated by measuring the time the transport conduit or suction pipe has a vacuum greater than a preset threshold (5" Hg) present while the valve is open, since the transport conduit and suction pipe have a high vacuum present when the vacuum valve is open and sewage liquid is present in the suction pipe. Once the transport conduit or suction pipe vacuum drops and the vacuum valve is still open, then air is being passed through the valve until the valve is close.

The valve pit apparatus is further characterized in that the computer uses the pressure in the sump sensor tube to determine the condition of sump overflow, whereby the sump overflow condition is when the incoming sewage exceeds that which can be accommodated by the sump, e.g., over the gravity lines. The pressure created in the sump sensor tube by the rise of sewage in the sump, and consequently the rise of sewage in the sensor tube, is communicated to the sump sensor tube pressure sensor that measures the pressure and electrically transmits the pressure level to the computer through the computer's signal input port. The computer determines the alarm condition of sump overflow when the sump sensor tube pressure reaches a preset threshold corresponding to the sump overflow level condition, which is usually the level of the gravity feed lines coming into the sump tank so as not to cut off the source of atmosphere pressure air to the sump via the gravity feed lines.

The valve pit apparatus is further characterized in that the computer has a signal output port, which is used to connect to external devices, e.g., a solenoid valve. The signal output port provides electrical energy at its electrical leads or terminals in pulses or continuous voltage potential.

The valve pit apparatus is further characterized in that the computer is connected through said signal output port to a solenoid valve for delivering vacuum or atmospheric pressure to the vacuum valve, wherein energizing/latching the solenoid valve in one direction delivers a vacuum to the vacuum valve which is used to open the vacuum valve and energizing/latching the solenoid valve in the opposite direction delivers atmospheric pressure to the vacuum valve which is used to close the vacuum valve. In other words, the computer controls the solenoid valve by sending a signal using the computer's signal output port to the solenoid valve, thereby delivering vacuum or atmospheric pressure to the vacuum valve which respectively actuates the vacuum valve to open or close.

The valve pit apparatus is further characterized in that the computer determines a sump full condition when the sump sensor tube pressure exceeds a preset threshold, wherein the compute uses the pressure in the sump sensor tube to determine the condition of sump full; thereby the sump is ready to be evacuated of sewage. In other words, a sump full condition is when the incoming sewage reaches a predetermined level, e.g., 10 gallons or 20% sump capacity or 10" from bottom of sump or 5" from bottom of sensor tube or some other sutible level for the valve pit design, and the vacuum valve should be opened to evacuate the sewage. The pressure created in the sump sensor tube by the rise of sewage in the sump, and consequently the rise of sewage in the sensor tube, is communicated to a pressure sensor that measures the pressure and electrically transmits the pressure level to the computer through said signal input port. The computer determines the sump full condition when the sensor tube pressure level reaches a preset threshold corresponding to the sump full condition, which is usually a sewage level of about 5" up the sump sensor tube from the end of the tube.

The valve pit apparatus is further characterized in that the computer determines the desired open/close state of the vacuum valve should be open when there is sufficient transport conduit vacuum and a sump full condition is present. The computer determines the desired open/close state of the vacuum valve should to be close after the vacuum valve has been open for a predetermined minimum time and the air-to-liquid ratio has reached a preset threshold and the. In other words, the vacuum valve is desired to be open when the transport conduit vacuum is sufficient and the sump full level is reached and to remain open until the air-to-liquid ratio is defined by the computer to be greater than a preset threshold value and the vacuum valve has been open for a predetermined minimum time, otherwise the vacuum valve is desired to be in the closed state once the air-to-liquid ratio has reached a preset threshold which occurs when sufficient air has entered the transport conduit following the liquid.

The valve pit apparatus is further characterized in that the computer determines the desired open/close state of the vacuum valve should be open if the sump overflow level is reached. The computer determines the desired open/close state to be close if the vacuum valve state is presently open and the air-to-liquid ratio has reached a preset threshold and the vacuum valve has been open for a predetermined minimum time. In other words, the vacuum valve is desired to be open when the sump overflow level is reached and to remain open until the air-to-liquid ratio is defined by the computer to be greater than a preset threshold value and the vacuum valve has been open for a predetermined minimum time, otherwise the vacuum valve is desired to be in the closed state once the air-to-liquid ratio has reached a preset threshold which occurs when sufficient air has entered the transport conduit following the liquid.

The valve pit apparatus is further characterized in that the computer determines the desired open/close state of the vacuum valve should be open if the transport conduit vacuum is below a preset threshold and the air admission remote control operating parameter is true. The computer determines the desired open/close state of the vacuum valve should be close if the vacuum valve state is presently open and the air-to-liquid ratio has reached a preset threshold and the vacuum valve has been open for a predetermined minimum time. In other words, the vacuum valve is desired to be open when the transport conduit vacuum is below a preset threshold and the air admission remote control operating parameter is true and to remain open until the air-to-liquid ratio is defined by the computer to be greater than a preset threshold value and the vacuum valve has been open for a predetermined minimum time, otherwise the vacuum valve is desired to be in the closed state once a preset minimum valve open time has been reached and the air-to-liquid ratio has reached a preset threshold which occurs when sufficient air has entered the transport conduit following the liquid.

The valve pit apparatus is further characterized in that the computer communicates through said signal output port to energize/latch the solenoid valve to open the vacuum valve when the vacuum valve is desired to be open and the computer has determined the valve is presently closed. In other words, if the valve is closed and the computer desires the valve to be open, then the computer will attempt to open the vacuum valve using the solenoid valve.

The valve pit apparatus is further characterized in that the computer communicates through said signal output port to energize/latch the solenoid valve to close the vacuum valve when the vacuum valve is desired to be closed and the computer has determined the valve is presently open. In other words, if the valve is open and the computer desires the valve to be close, then the computer will attempt to close the vacuum valve using the solenoid valve.

The valve pit apparatus is further characterized in that the apparatus has a radio frequency transceiver for wirelessly communicating to and from another wireless communication device external of the valve pit for Drive-by and Fixed-base data exchange, whereby enabling the wireless transmission of historical and present valve pit conditions from the valve pit to a wireless communication device external to the valve pit and enabling the reception of operating parameters, which control the operations of the valve pit, from a wireless communication device external to the valve pit.

The valve pit apparatus is further characterized in that the suction pipe sensor has at least two vacuum switches with the first suction pipe vacuum switch having a preset threshold equal to a point in the lower 50% portion of the suction pipe, whereby sewage reaching this point in the lower 50% portion of the suction pipe will actuate the vacuum switch and a second suction pipe vacuum switch with a preset threshold greater than said first suction pipe vacuum switch by at least 1" of Mercury and less than the highest vacuum obtained when the suction pipe is completely full of sewage, which is due to suction from the sewer system.

The valve pit apparatus is further characterized in that the transport conduit sensor has at least two vacuum switches with the first transport conduit vacuum switch with a preset threshold equal to a level in the range of 4" to 6" of Mercury and a second transport conduit vacuum switch with a preset threshold less than 16" of Mercury and greater than said first transport conduit vacuum switch by at least 1". In operation, the vacuum falls below the preset threshold of both the first and second vacuum switches when the vacuum valve opens, whereby allowing measurement of vacuum recovery time between the two switches after the vacuum valve closes.

The valve pit apparatus is further characterized in that the sump sensor tube sensor has at least two pressure switches with the first pressure switch having a preset threshold equal to a sump full level, whereby sewage reaching this sump full level in the sump sensor tube will actuate the first pressure switch, and a second pressure switch with a preset threshold equal to an sump overflow level, whereby sewage reaching this sump overflow level in the sump sensor tube will actuate this second pressure switch.

The valve pit apparatus is further characterized in that the apparatus has a battery power supply, whereby the computer, sensors, wireless transceiver, and solenoid valve do not need a power source external to valve pit.

The valve pit apparatus is further characterized in that the computer determines a periodic sewage usage rate to be the summation of liquid flow time operating parameter over a predetermined periodic time period, which is the amount of sewage being evacuated from the sump over the predetermined period of time. This value is stored in memory and retrievable by an operator or central control computer to view in a chart to observe sewage usage patterns. This sewage usage information is also useful in calculating the amount of leakage in the sewer system by summing all sewage usages of the entire system and comparing to the amount of sewage flow in a transport conduit using the transport conduit apparatus. The difference between the summation of all sewage usages and the sewage flow in a sewer main will be the amount of water infiltration and inflow due to transport conduit leaks or illegal connections.

The valve pit apparatus is further characterized in that the computer determines weather to inject air into the sewer main for purging the transport conduit in the event of a waterlogged situation detected by the operator or central control computer. The valve pit apparatus computer will open the vacuum valve and inject air into the transport conduit if the transport conduit vacuum is below a preset threshold and the air admission remote control operating parameter equals a true state. The air admission remote control operating parameter can be set to true or false through wireless communications by the operator or central control computer using Drive-by or Fixed-Base communications. The central control computer can decide to set the admission remote control operating parameter to true on a valve pit apparatus if the computer detects a waterlog alarm originating from a transport conduit apparatus or a valve pit apparatus.

The valve pit apparatus is further characterized in that the apparatus has a water-proof housing, whereby the components of the apparatus are enclosed in the housing and the apparatus is able to operate while submersed in water and having minimum requirements to meet a rating of "IP68" as defined in International Standard IEC 60529.

The valve pit apparatus is further characterized in that the apparatus has an explosion-proof housing, whereby the components of the apparatus are enclosed in the housing and the apparatus is able to operate in a hazardous location. Hazardous locations comprise areas such as hydrocarbon drilling operations, natural gas processing and transmission facilities, underground sewer facilities, as well as dust-laden operations such as grain processing facilities. For instance, Article 500 of the National Electrical Code ("NEC") NFPA 70 has classified certain locations as hazardous, including Class I (combustible material in the form of gas vapors) and Class II (combustible material in the form of dust).

In the vacuum sewer system arranged as shown in FIG. 5, an operational vacuum sewage system requires that each sewage inlet point, typically serving one or more houses, include a vacuum valve 530 and a valve pit apparatus 500, which allows intermittent passage of accumulated sewage 551 into an associated transport conduit 520 network connected at the other end to a collection tank, and thereafter ultimately to a sewage treatment plant. As disclosed in U.S. Pat. No. 4,179,371, issued to B. E. Foreman et al., this transport conduit is typically laid with a saw-toothed profile with a combination of a riser conduit portion 521, low-point conduit portion 522, and down-slope conduit portion 523 (collectively called a "lift") repeated throughout the length of the sewer main to accommodate the topography (e.g., other conduits and rock layers), as well as incoming flows from transport conduits leading to other individual vacuum valves. The slope of the down-slope conduit portions of the profile is such that the drop between lifts is generally equivalent to at least 40% of the conduit diameter (80% if the diameter is smaller than 6") or 0.2% of the distance between lifts, whichever is greater. Generally, the transport conduit network is continuously maintained under vacuum or sub-atmospheric pressure. Sewage and air, usually at atmospheric pressure, are introduced for transport into the conduit through an open vacuum valve 530. The air moves down the length of the conduit to the area under vacuum or sub-atmospheric pressure where the air expands volumetrically. The energy created by the rapid movement of air in response to the differential pressure condition in the conduit in turn produces rapid sewage transport downstream throughout the conduit system, whereby passing sewage through the riser conduit portion 521. The riser conduit portion has a transport conduit apparatus associated, comprising a riser conduit sensor 550 and computer 551. At a predetermined point in time, however, the vacuum valve will close, thereby ending the sewage transport cycle. The expansion of air causes a reduction in its pressure and velocity, and any residual waste not transported through the conduit network during the sewage transport cycle comes to rest. The conduit downstream of the vacuum valve is equalized by the source of vacuum pressure to a substantially constant sub-atmospheric or vacuum pressure condition throughout. Any residual waste not transported through the conduit during the sewage transport cycle will generally come to rest in the low point portion, permitting vacuum or sub-atmospheric pressure to be communicated upstream and maintained throughout the entire conduit section.

As illustrated in FIG. 6, reference numeral 650 denotes a riser conduit sensor. One end of the riser conduit sensor 650 is communicated with the vacuum in the upper end of the riser conduit portion 621 through a pipe assembly 653 and the other end of the riser conduit sensor 650 is communicated with the vacuum in the lower end of the riser conduit portion 621 through a pipe assembly 652. With this low impedance piping arrangement, measuring the pressure between the two ends of the riser conduit sensor 650 gives the same differential pressure across the length of the riser conduit sensor 621.

The riser conduit sensor 650 in FIG. 6, uses transducers to covert the differential pressure to electrical signals that are transmitted to a transport conduit apparatus computer 651 through electrical conductors 654.

The transport conduit apparatus computer 651 in FIG. 6, in accordance with the present invention, having an electronic computer circuitry, conventional wireless modem circuitry, signal converter circuitry, and power supply circuitry, as is known in the art, and will not be presented here for simplicity.

The transport conduit apparatus computer 651, as illustrated in FIG. 6, includes an explosion-proof, water-proof housing for covering, protecting and supporting the internal components encased within, along with providing mechanical structure for interfacing to external devices. Although the invention is illustrated herein with reference to a valve pit apparatus with an explosion-proof, water-proof housing, the invention is alternatively applied to other applications without need of an explosion-proof, water-proof housing, for example, a vacuum valve mounted above the ground in a non-hazardous location, on a wall, or in another apparatus that needs use of a vacuum valve in a vacuum sewer system without need of an explosion-proof nor water-proof housing.

In accordance with the present invention, one embodiment of the transport conduit apparatus comprises a computer portion 651, a riser conduit sensor 650, a riser conduit portion 621, a riser conduit upper end pipe assembly 653, riser conduit lower end pipe assembly 652, a low-point conduit portion 622, and a down-slope conduit portion 623. Other embodiments in accordance with the present invention could have a riser conduit sensor measuring a two gauge pressures with reference to atmosphere pressure, one at each end of the riser conduit, and then subtract the two for the same differential pressure measurement, which will not be presented here for simplicity. All such modifications and variations are within the scope of the invention as determined by the appended claims.

The transport conduit apparatus computer 651, as illustrated in FIG. 6, in accordance with the present invention, having an explosion-proof, water-proof housing, as is known in the art, and will not be presented here for simplicity.

As illustrated in FIG. 6, a transport conduit apparatus comprises a low point conduit 622, a riser conduit 621, and a down-slope conduit 623. Sewage flow through the transport conduit apparatus starts with the sewage entering the low-point conduit, pulled-up through the riser conduit, and out the down-slope conduit. Typically, the riser conduit is at 45 degree angles with the low-point and down-slope conduits, and the low-point conduit is parallel with the down-slope conduit. However, these angles can be something other than 45 degrees and still give similar results as long as the riser conduit has a static lift that can be measured using differential pressure sensors across the riser conduit.

As illustrated in FIG. 6, a riser conduit sensor 651 is communicated with each end of the riser conduit 621 and used for measuring the differential pressure within the riser conduit portion to define a riser conduit operating parameter. The conduit sensor has a means of communicating to the riser conduit that enables the measurement of differential pressure within said riser conduit portion as a result of sewage weight potential within said riser conduit portion.

As illustrated in FIG. 6, a transport conduit apparatus has a computer for processing the measured riser conduit differential pressure. The computer has at least one processor or embedded controller, at least one signal input port, and some memory, whereby enabling the computer to process, record, and save operating parameters and their respective time of measurements.

In accordance with the present invention, the transport conduit apparatus is further characterized with the computer defining an air-to-liquid flow time ratio operating parameter by measuring the time duration of air flow and time duration of liquid flow and then dividing to two for a ratio of air-to-liquid flow. The liquid flow time duration is determined by measuring the length of time that liquid sewage is present in the riser. This is achieved by detecting a pressure differential in the riser conduit; since liquid will create a pressure differential due to weight and air will have no weight and therefore no differential pressure. A digital filter, e.g. low-pass, mean, or moving average, is applied to the air-to-liquid time ratio processing so that the air-to-liquid time ratio results are dependent on past history air-to-liquid time ratio results.

The transport conduit apparatus is further characterized with the computer capable of determining a waterlogged transport conduit alarm to be true when the air-to-liquid flow time ratio operating parameter is lower than a preset threshold. This follows the reasoning that a good flowing system should have three times more air than liquid in the transport conduit and a waterlogged line will have much more liquid than air in the transport conduit.

The transport conduit apparatus is further characterized with the computer capable of determining the sewage flow rate through the transport conduit by summing the liquid flow time over a predetermined periodic time interval for a total value and then multiply this total value times a constant value, which is dependant on pipe size, typical air-to-sewage mixture consistency, and typical flow velocity.

The transport conduit apparatus is further characterized with the computer having a radio frequency transceiver for wirelessly communicating operating parameters to and from a wireless communication device external of the transport conduit apparatus for data exchange, whereby enabling the wireless transmission of operating parameters from the transport conduit apparatus to a wireless communication device external of the transport conduit apparatus and enabling the reception of operating parameters from a wireless communication device external of the transport conduit apparatus.

The transport conduit apparatus is further characterized with the riser conduit sensor consisting of a differential pressure switch with a preset threshold equal to a point in the lower 50% portion of the riser conduit portion, whereby sewage reaching this point in the lower 50% portion of the suction pipe will actuate the differential pressure switch, and a second differential pressure switch with a preset threshold greater than said first riser conduit differential pressure switch by at least 4" of water. Differential pressure is measured across the riser conduit so that reference to atmospheric pressure is not necessary, whereby not needing an air breather that can be flooded during rain storms.

The transport conduit apparatus is further characterized with the computer having a battery power supply, whereby the computer not having the need for use of a power source external to transport conduit apparatus.

The transport conduit apparatus is further characterized with the computer having a water proof housing, whereby the components of the computer are enclosed in the housing and the computer is able to operate while submersed in water.

The transport conduit apparatus is further characterized with the computer having an explosion-proof housing, whereby the computer is enclosed in the explosion-proof-housing and able to operate in a hazardous location. Hazardous locations comprise areas such as hydrocarbon drilling operations, natural gas processing and transmission facilities, underground sewer facilities, as well as dust-laden operations such as grain processing facilities. For instance, Article 500 of the National Electrical Code("NEC") NFPA 70 has classified certain locations as hazardous, including Class I (combustible material in the form of gas vapors) and Class II (combustible material in the form of dust).

A distributed control system for a vacuum sewer system having a suction pipe which is communicated with a vacuum source via a transport conduit by opening a vacuum valve, and which is cut off from the vacuum source by closing said vacuum valve so that sewage in a sewage sump is sucked through said suction pipe and sent to a predetermined place by opening said vacuum valve. The distributed control system having a plurality of valve pit apparatus equipped with wireless transceivers, a plurality of transport conduit apparatus equipped with wireless transceivers, and a central control computer equipped with a wireless transceiver. The central control computer is capable of sending and receiving operating parameters to and from the valve pit apparatus and the transport conduit apparatus.

The distributed control system is further characterized with the central control computer having capability to determine a leak in a transport conduit. The central control computer monitors the flow of sewage through the transport conduit and compares the flow to all the valve pits upstream of the transport conduit. The sewage flow rate through the transport conduit over a pre-determined time period should equal the sewage flow of all the valve pits upstream of the transport conduit. If the sewage flow rate of the transport conduit is greater than all the upstream valve pits, then there is a leak in the transport conduit allowing water infiltration.

The distributed control system is further characterized with the central control computer having the capability of enabling a valve pit apparatus to purge the transport conduit downstream of the valve pit. The central control computer monitors the transport conduit apparatus and when a water-log condition is detected, the central control computer will notify the nearest valve pit upstream and request the valve pit apparatus to purge the transport conduit. The detection of a waterlogged transport conduit alarm will initiate the purging with air of the transport conduit section by opening the nearest vacuum valve upstream of the transport conduit section using said solenoid valve of said valve pit apparatus.

The distributed control system is further characterized with the central control computer having a means of visually displaying the operating parameters of the valve pit apparatus and transport conduit apparatus on an LCD monitor for human operator users. The LCD display is typically mounted on the wall of the public works office for easy viewing.

The distributed control system is further characterized with the central control computer having a means of notifying human operators via email, cell phone, and pagers of alarm conditions determined from the operating parameters obtained from the valve pit apparatus and transport conduit apparatus.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiments were chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

I claim:

1. An apparatus for a vacuum sewer system comprised of a suction pipe having a first end that is connected to a sewage sump and a second end that is connectable to a vacuum source via a vacuum valve, the apparatus comprising:

sensors comprising at least one vacuum sensor to measure a vacuum in the suction pipe, the vacuum in the suction pipe being based, at least in part, on a height of sewage in the suction pipe;

at least one processor to determine an air-to-liquid ratio through the vacuum valve by performing operations that comprise:

determining a liquid flow through the vacuum valve based on a duration that a vacuum in the suction pipe is greater than a threshold; and determining a an air flow through the vacuum valve based on a duration following the vacuum in the suction pipe being below the threshold; and a solenoid valve for controlling application of vacuum or pressure to the vacuum valve based on the air-to-liquid ratio.

2. The apparatus of claim 1, wherein the vacuum valve is between the suction pipe and a transport conduit connected to the vacuum source;

wherein the at least one processor is for determining a vacuum valve state operating parameter that represents a state of the vacuum valve based on (i) a transport conduit vacuum operating parameter that is indicative of a vacuum in the transport conduit, and (ii) a suction pipe vacuum operating parameter that is indicative of the vacuum in the suction pipe, the vacuum valve state operating parameter representing a close state if the transport conduit vacuum operating parameter is greater than a first threshold and the suction pipe vacuum operating parameter is less than a second threshold, the close state indicating that the vacuum valve is closed, the vacuum valve state operating parameter representing an open state if the transport conduit vacuum operating parameter is less than the first threshold and the suction pipe vacuum operating parameter is greater than the second threshold, the open state indicating that the vacuum valve is opened, the vacuum valve state operating parameter representing a partially open state if the transport conduit vacuum operating parameter is greater than the first threshold and the suction pipe vacuum operating parameter is greater than the second threshold, the partially open state indicating that the vacuum valve is partially opened, and the vacuum valve state operating parameter representing an unknown state if the transport conduit vacuum operating parameter is less than the first threshold and the suction pipe vacuum operating parameter is less than the second threshold, the unknown state indicating that a state of the vacuum valve is indeterminate; and wherein the at least one processor is for performing at least one of the following operations: storing the vacuum valve state operating parameter in memory, or communicating the vacuum valve state operating parameter to an external device.

3. The apparatus of claim 2, wherein the at least one processor is for indicating when the vacuum valve is partially open.

4. The apparatus of claim 1, wherein the at least one processor is for determining a vacuum valve flow rate operating parameter by performing operations comprising:

obtaining a time duration that it takes for the vacuum in the suction pipe to increase from a first value to a second value; and obtaining a quotient based on a geometry of the suction pipe and the time duration, the quotient corresponding to the vacuum value flow rate operating parameter; and wherein the at least one processor is for performing at least one of the following operations: storing the vacuum valve flow rate operating parameter in memory, or communicating the vacuum valve flow rate operating parameter to an external device.

5. The apparatus of claim 4, wherein the at least one processor is for indicating an alarm when the vacuum valve flow rate operating parameter is greater than a threshold.

6. The apparatus of claim 1, wherein the vacuum valve is between the suction pipe and a transport conduit connected to the vacuum source;

wherein the at least one processor is for performing operations comprising:

determining a level of vacuum in the transport conduit; and determining a vacuum recovery time for the transport conduit based on a time that it takes for the level of vacuum to increase to a set level after the vacuum valve is closed; and wherein the at least one processor is for performing at least one of the following operations: storing the vacuum recovery time in memory, or communicating the vacuum recovery time to an external device.

7. The apparatus of claim 6, wherein the at least one processor is for indicating an alarm notifying of an obstruction in the transport conduit when the vacuum recovery time is greater than a threshold.

8. The apparatus of claim 1, wherein the vacuum valve is between the suction pipe and a transport conduit connected to the vacuum source, a vacuum recovery time for the transport conduit comprising a time that it takes for the transport conduit to reach a set level of vacuum following closure of the vacuum valve;

wherein the at least one processor is that for determining the transport conduit is waterlogged by performing operations comprising:

determining a first vacuum recovery time for the transport conduit;

determining that the first vacuum recovery time is below a threshold while the vacuum valve is closed;

determining a second vacuum recovery time based on a time for the level of vacuum in the transport conduit to increase a fixed amount; and determining that the second vacuum recovery time is less than the first vacuum recovery time; and wherein the at least one processor is for performing at least one of the following operations: storing data in memory indicating that the transport conduit is waterlogged, or communicating the data to an external device.

9. The apparatus of claim 1, wherein the vacuum valve is between the suction pipe and a transport conduit connected to the vacuum source;

wherein the at least one processor is for determining the air-to-liquid ratio by performing operations comprising:

determining a quotient based on the air flow and the liquid flow, the quotient corresponding to the air-to-liquid ratio.

10. The apparatus of claim 1, wherein the vacuum valve is between the suction pipe and a transport conduit connected to the vacuum source;

wherein the at least one processor is for determining a sewage usage rate by performing operations comprising:

determining a liquid flow time through the suction pipe based on a duration that a vacuum in the suction pipe is greater than a threshold;

determining a valve pit flow based on a diameter of the suction pipe and a size of the vacuum valve;

summing the liquid flow time over a time period to produce a summation; and multiplying the summation by the valve pit flow; and wherein the at least one processor is for performing at least one of the following operations: storing the sewage use rate in memory, or communicating the air sewage use rate to an external device.

11. The apparatus of claim 1, wherein the vacuum valve is between the suction pipe and a transport conduit connected to the vacuum source; and wherein the at least one processor is for determining whether to admit air into the transport conduit based on a level of vacuum in the transport conduit.

12. The apparatus of claim 1, wherein the at least one processor is also for controlling the solenoid valve to control operation of the vacuum valve.

13. The apparatus of claim 12, wherein the at least one processor is for causing the solenoid valve to latch in a first direction to provide the vacuum to the vacuum valve to open the vacuum valve, and to latch the solenoid valve in a second direction to provide the pressure to the vacuum valve to close the vacuum valve, the pressure being atmospheric pressure.

14. The apparatus of claim 1, wherein the sewage sump comprises a sensor tube in the sewage sump, the sensor tube being configured to detect pressure in the sewage sump based on a rising amount of sewage in the sewage sump;

wherein the sensors comprise a pressure sensor to obtain the pressure from the sensor tube and to provide the pressure to the at least one processing device; and wherein the at least one processor is for performing at least one of the following operations: storing data representing the pressure in memory, or communicating the data to an external device.

15. The apparatus of claim 14, wherein the at least one processor is for determining that the sewage sump is full based on the pressure obtained from the sensor tube exceeding a threshold; and wherein the at least one processor is for performing at least one of the following operations: storing data in memory indicating that the sewage sump is full, or communicating the data to an external device.

16. The apparatus of claim 14, wherein the at least one processor is for determining that the sewage sump has overflowed based on the pressure obtained from the sensor tube exceeding a threshold; and wherein the at least one processor is for performing at least one of the following operations: storing data in memory indicating that the sewage sump has overflowed, or communicating the data to an external device.

17. The apparatus of claim 1, wherein the at least one processor is for determining a parameter based, at least in part, on the air-to-liquid ratio;

wherein the vacuum valve is between the suction pipe and a transport conduit connected to the vacuum source; and wherein the parameter comprises a vacuum valve control state operating parameter that is usable by the at least one processor to control the vacuum valve, the vacuum valve control state operating parameter representing an open state when the sewage sump is full and a vacuum level in the transport conduit exceeds a threshold, the open state indicating that the vacuum valve is to be open, the vacuum valve control state operating parameter representing an open state when the sewage sump has overflowed, the vacuum valve control state operating parameter representing an open state when air is to be admissible to the transport conduit, and the vacuum valve control state operating parameter representing a close state when:

the vacuum valve has been open for a time duration greater than a threshold, and the air-to-liquid ratio is greater than a threshold, the close state indicating that the vacuum valve is to be closed.

18. The apparatus of claim 17, wherein the at least one processor is for controlling the solenoid valve to control operation of the vacuum valve based, at least in part, on the vacuum valve control state operating parameter.

19. The apparatus of claim 18, wherein the at least one processor is for causing the solenoid valve to close the vacuum valve when the vacuum valve control state operating parameter is in the close state and the vacuum valve is already open.

20. The apparatus of claim 1, wherein the sewage sump comprises a sensor tube in the sewage sump, the sensor tube being configured to sense a pressure in the sewage sump; and wherein the sensor tube comprises:

a first pressure switch having a threshold equal to a sump full level and configured so that sewage reaching the sump full level actuates the first pressure switch; and a second pressure switch having a threshold equal to a sump overflow level and configured so that sewage reaching the sump overflow level actuates the second pressure switch.

21. The apparatus of claim 1, wherein the at least one vacuum sensor comprises:

a first switch having a first threshold at a point in a lower half of the suction pipe and configured so that sewage reaching the first threshold actuates the first switch; and a second switch having a second threshold greater than the first threshold by at least one inch of mercury.

22. The apparatus of claim 1, wherein the sensors comprise an acoustic sensor to measure acoustic energy in a vacuum valve pit containing the vacuum valve, wherein the acoustic sensor is configured to read from the vacuum valve pit at a location that includes acoustic energy resulting from flow of sewage or air through components in the vacuum valve pit; and wherein the at least one processor is for performing at least one of the following operations: storing data representing the acoustic energy in memory, or communicating the data to an external device.

23. The apparatus of claim 1, wherein the vacuum valve is between the suction pipe and a transport conduit connected to the vacuum source;

wherein the sensors comprise a transport conduit vacuum sensor to measure a vacuum in the transport conduit, wherein the transport conduit vacuum sensor is configured to read from the transport conduit at an interface between the vacuum valve and the transport conduit; and wherein the at least one processor is for performing at least one of the following operations: storing data representing the vacuum in the transport conduit in memory, or communicating the data to an external device.

24. The apparatus of claim 23, wherein the transport conduit vacuum sensor comprises:

a first transport conduit vacuum switch having a first threshold in a range of four inches to six inches of mercury; and a second transport conduit vacuum switch having a second threshold greater than the first threshold by at least one inch of mercury.

25. The apparatus of claim 1, wherein the at least one processor is for outputting a signal to control a first valve that controls operation of the vacuum valve based, at least in part, on the air-to-liquid ratio.

* * * * *